United States Patent [19]

Halm

[11] Patent Number: 4,864,751

[45] Date of Patent: Sep. 12, 1989

[54] TELEPHONE INDEX

[75] Inventor: Hans Halm, Herne, Fed. Rep. of Germany

[73] Assignee: Confon AG, Switzerland

[21] Appl. No.: 67,450

[22] Filed: Jun. 25, 1987

[30] Foreign Application Priority Data

Oct. 1, 1986 [DE] Fed. Rep. of Germany ... 8626166[U]

[51] Int. Cl.[4] ..... B42F 17/34

[52] U.S. Cl. ..... 40/381; 40/336

[58] Field of Search ..... 40/336, 337, 338, 339, 40/375, 380, 381, 382, 513

[56] References Cited

U.S. PATENT DOCUMENTS

| | | | |
|---|---|---|---|
| 2,968,110 | 1/1961 | Quarnstrom | 40/375 |
| 3,167,371 | 1/1965 | Parcher et al. | 40/381 X |
| 3,276,155 | 10/1966 | Conia | 40/375 |
| 3,423,862 | 1/1909 | Koller | 40/375 |
| 3,721,485 | 3/1973 | Begrer | 40/336 X |
| 3,747,244 | 7/1973 | Koller | 40/375 |
| 4,351,125 | 9/1982 | Yuen | 40/381 |

FOREIGN PATENT DOCUMENTS

| | | | |
|---|---|---|---|
| 2741138 | 8/1980 | Fed. Rep. of Germany . | |
| 897974 | 4/1945 | France | 40/336 |
| 1569217 | 5/1969 | France . | |
| 2053095 | 2/1981 | United Kingdom | 40/381 |

*Primary Examiner*—John Fox

*Attorney, Agent, or Firm*—Stanger, Michaelson, Reynolds, Spivak & Tobia

[57] ABSTRACT

The telephone index has a plurality of selection keys and a spring-operated drawer witha stack of index cards, which is held in the index housing by means of a locking device in such a way that on operating a selection key the drawer locking means is released and consequently the drawer with the selected index card and the index cards below it is extended, while the index cards located above the selected card are held back in the index housing by means of a card hold-back device released by the operated selection key and is constructed in such a way that the unlocking of the drawer on operating a selection key takes place by a drawer position change in such a way that in its front region the drawer is lowered counter to the tension of a spring element and simultaneously the drawer locking means is released on the upper edge of the housing opening for the drawer, so that the drawer can be extended, the drawer locking means comprising a stop cam shaped onto the upper edge of the front drawer terminal ledge and which ensures that in the inserted state the drawer is held in the index housing.

19 Claims, 16 Drawing Sheets

TELEPHONE INDEX

BACKGROUND OF THE INVENTION

The invention relates to a telephone index with an index card selection device, comprising a housing having a cover part and a base part with a plurality of selection keys and with a drawer under the action of a pretensioned spring and which can be closed by means of a locking device for receiving a stack of a plurality of index cards with selection stampings formed in the front region, whereby when the selection keys are operated by means of card hold-back pins they engage in selection stampings of the index cards on extending the drawer with the selected index card and the index cards located below it, drivers on the bottom of the drawer for engaging the selected index card and the underlying index cards on extending the drawer and a device controllable by means of selection keys for releasing the locking device for the drawer. Numerous different constructions are known of telephone indexes with selection devices. They comprise a housing for receiving a stack of loose index cards and a keyboard with correspondingly marked finger keys, whose operation makes it possible to select the desired cards. Random instructions or notes for subsequent reference purposes can appear in alphabetical order on the index cards.

A telephone index is known, which comprises a housing having a drawer under the action of a thrust spring and closed by a bolt for receiving the index cards and with a device for unlocking the drawer and releasing the index cards selected by means of a set key through the unlocked drawer being pressed down by means of the thrust spring.

Furthermore, DE-A-23 06 961 discloses a device for selecting one of many cards stored in a housing, which are selected by key pressure and re horizontally stacked in a drawer, arranged in an opening in the front wall of the housing and being horizontally slidable into the housing in a closed position and out of the housing in an open position and in which they are locked against pretension. For this purpose a latch is provided with a clip member, which is movable fixed and pretensioned in the housing and engages in a notch in the drawer. A key lever is provided for each card and has a rod pivotably fixed in the housing, whereby one end of the lever carries a manually operable key located outside the housing, whereas the other lever end is on the one hand provided with a shoulder for unlatching the clip member from the drawer on operating the key and on the other hand has a shoulder which so cooperates with the cards having aligned recesses, that on pressing down the key all the cards located above that card associated with said key are prevented from moving with the drawer, whereas the selected card and all cards below it can be moved out with the drawer. In the case of said known telephone indexes a number of card drivers or dogs corresponding to the number of cards is pivotably articulated to the drawer and which by means of shoulder positioned at the key lever end opposite to the key can be moved into an engaged position on the rear edge of the selected and underlying cards on pressing down the corresponding key, whilst the shoulder cooperating with the cards is constructed in such a way that it simultaneously engages in a recess of all cards located above the selected card to prevent movement thereof.

In another telephone index known from FR-A-1 569 217, the cards located above the selected card are engaged and raised on the trailing edge thereof by a shoulder of the associated key lever on pressing down a particular key, so that the cards together with their recesses are guided over a holding projection on the housing cover. Said projection secures the raised cards, whilst the remaining cards free on the bottom of the drawer are carried along by the outwardly moving drawer and for this purpose are positionally secured on their trailing edge by a projection on the bottom of the drawer. On releasing the key the rod of the key lever is immediately pivoted back, so that the previously raised cards with their recesses are again freed from the holding projection on the housing cover. In this construction the two-armed selection lever has on its one arm end the operating key and on its other end a section bent in the direction of the front of the device, which engages below the card stack above the selected card and raises the same and simultaneously a holding nose shaped onto the inner wall of the upper housing cover engages through an opening in the rear lever arm, through the aligned openings of the raised card stack and in a slot-like opening in the bent section. As a result of this construction, it is ensured that unselected index cards located above the selected card are held back on extending the selected card with the cards positioned below it. This telephone index also operates with a clip member, which can be brought into operative engagement with a shoulder shaped onto the rear lever arm end when the corresponding selection lever is operated. By means of this clip member the arresting action for the drawer is released, so that the drawer with the selected index card and the card stack located below it can be extended.

In a telephone index known from US-A-3 818 622, the card hold-back pin of each pivoted lever comprises a roughly U-shaped portion shaped onto the end of the lever with a leg running towards the selection keys and with a vertical, upwardly directed bar shaped onto its end and which on operating a pivoted lever engages from below in the index card openings or recesses. Here again a separate device is provided which cooperates with the hold-back pin to ensure that the index cards above the selected card to be extended are satisfactorily held back.

DE-A-27 41 138 discloses a telephone index with an index card selection device, comprising a housing having a cover part and a base part with a plurality of serially juxtaposed and superimposed selection keys and a drawer under the action of a compression spring and closable by means of a locking device, with a stack of index cards housed therein which have selection tongues in their rear edge portions, together with openings, whereby the tongues are enlarged in step-like manner from the card with the first opening from on side to the other to the overlying card by in each case one selection tongue carrying an opening. Each selection key is fixed to one end of a pivoted lever, which carries at its other end a card hold-back pin, which has an approximately U-shaped portion shaped onto the pivoted lever end with a leg directed towards the selection keys and on the end thereof a vertical, upwardly directed bar which on operating the pivoted lever engages from below into the index card openings or recesses. The card hold-back pins of the pivoted lever are arranged in series and cooperate with the index cards in such a way that on pressing down one selection key, all the index cards located above the card associated with said key are held back on moving out the drawer through the insertion of the card hold-back pins into the openings of the selection tongues of the cards, whilst the selected index card and all those cards located below it are moved out with the drawer. There is also device operable by means of the pivoted levers of the selection keys for unlocking the drawer and which comprises a clip member articulated to the housing, the web of said member running transversely to the longitudinal direction of the pivoted lever rests thereon above the latter and is subjected to the action thereof and which cooperates with a cam shaped onto the drawer in such a way that on raising the clip member on operating a selection key the locking part of the clip member is disengaged from the cam, so that the drawer, provided with driving cams for engaging in driving stampings of the cards is extended by means of spring tension. This telephone index is characterized by the combination of the following features. The selection keys of the pivoted levers comprise plate-like, square or rectangular blanks fixed to first ends thereof, whereby the serially succeeding selection keys have a width corresponding to the width of in each case three pivoted levers carrying the keys and which are connected therewith in such a way that the selection key facing the hold-back pins on the rear ends of the pivoted levers project over to the right the two adjacent pivoted levers and the front selection key pivots to the left over the two adjacent pivoted levers and the central selection key engages to the right and left over the pivoted levers on either side of said selection key. The vertically upwardly directly bar of each card hold-back pin has a cam-shaped shoulder running parallel to the leg of the U-shaped portion of the hold-back pin. The drawer comprising a plate-like drawer bottom and a front terminal ledge or strip closing the drawer extension opening in the housing front wall when the drawer is inserted is open at the back and on either side and is provided in its rear edge region with a number of slot-like recesses corresponding to the number of hold-back pins with a length corresponding to the length of the U-shaped portions at the ends of the pivoted levers. The two lateral drawer boundary walls are formed by two walls on either side of the plate-like drawer bottom and shaped onto the inner wall surface of the housing cover part. For guiding the pivoted levers, each pivoted lever is provided on the end carrying the card hold-back pin with a vertically directed, slot-like opening, in which engages a cam shaped onto the inner wall surface of the housing cover part and is guided in opening. In summarizing it is pointed out that the known selection devices of telephone indexes have a very complicated construction, because the number of key levers corresponds to the number of selection keys and they carry card hold-back pins so as to permit a selection of the index cards. In addition, the known telephone indexes comprise a plurality of components, so that index assembly is labour-intensive and costly. In order to ensure that when operating the selection keys the unselected index cards remain in the housing on extending the drawer with the selected index card and those cards located beneath it, the cards are provided with hole-like openings, in which engage card hold-back pins. When such telephone indexes are frequently used, these hole-like openings become deformed. The edge regions of the openings are damaged, tear and consequently incorrect operations often occur. In addition, further driving stampings are provided in the index cards and they are generally in the form of hole or slot-like openings in said cards, so that driving cams shaped on the drawer bottom can engage therein so that, on extending the drawer, the selected index card and the underlying index cards are engaged and supplied with the extending drawer. These driving stampings in the index cards are also subject to damage.

The problem of the invention is to provide a telephone index comprising very few parts, so that there are very short assembly times and the manufacture of the telephone index is very inexpensive, in which the index cards do not have to be used in a predetermined order and in which there is no need for additional locking and unlocking devices, the locking and unlocking of the drawer with the index card stack taking place by drawer position changes.

SUMMARY OF THE INVENTION

The problem of the present invention is solved in that the drawer is held in the raised locking position by means of a spring element or by means of magnetic forces in its front region at a distance from the base plate of the base part in the housing, accompanied by simultaneous locking on the cover part of the housing by means of a stop formed on the latter and each selection key has a release arm acting on the front area of the drawer on operating the selection key and a card hold-back pin pivoting simultaneously with the release arm and preferably in advance and having a rearwardly directed index card abutting surface, whereby on pressing down a selection key the drawer with its front area can be pressed down against the spring element and in the direction of the base plate of the base part, accompanied by the simultaneous release of the locking of the drawer on the cover part by means of the release arm and the card hold-back pin can be lowered onto the in each case selected index card, whilst simultaneously holding back the index cards located above said card.

A telephone index constructed in this way comprises only a few parts, namely four parts, i.e. the base part with spring, the cover part, the selection key plate and the drawer with the necessary number of index cards. The selection key plate combines all those components which are necessary for the selection of the individual index cards and for extending the drawer on performing a selection process. As a result of the few components, it is easy to assemble the telephone index and assembly is possible in a very short time even by untrained personnel. Many components, such as key levers, control clips for unlocking the drawer, bearing pin for the key levers, etc. are rendered superfluous. In addition, no specially designed unlocking device for the drawer is provided, because the drawer is unlocked on operating a selection key by changing the position of the drawer, in that on operating a key the drawer is lowered with its front area counter to the tension of a spring element and simultaneously the drawer locking means on the upper edge of the front wall of the cover part of the index housing is released, so that the drawer subject to the action of a spring and together with the selected index card and the cards below it can be extended. It is extremely simple to lock the drawer in the telephone index housing and this is brought about by a stop cam shaped onto the upper edge of the front drawer terminating ledge and which when the drawer is inserted is engage on the front wall of the housing cover part. The front wall of the cover part, which bounds the upper region of the drawer extension opening, prevents the drawer from passing out of the housing without operating a selection key. By means of a resilient-elastic portion formed in the base plate of the base part of the housing, the drawer is kept in the raised and consequently locking position. On operating a selection key the drawer with its front region is pressed downwards against the resilient-elastic tongue, so that the drawer with its front region is lowered, so that the movement path for the stop and locking cams on the drawer is released, because as a result of the lowering of the front region of the drawer the locking cam on the front terminal ledge is lowered and is moved beneath the edge of the front wall of the cover part. If the extended drawer is inserted in the index housing, then the drawer is automatically locked by means of the resilient-elastic portion on the base plate of the base part of the housing by raising the front region of the drawer. This portion is automatically moved back from its lower position unlocking the drawer into its starting position, in which the drawer is raised and locked in the housing.

The holding back of all the index cards located above the selected index card takes place by means of a card hold-back pin, which is also operated by means of a selection key, a pin being associated with each release arm. The arrangement or association of the card hold-back pin with the release arm is such that on depressing the release arm by means of a selection key the pin is in advance of the release arm, so that before the latter strikes against the front terminal ledge of the drawer, the corresponding card hold-back pin is moved so far through the driving stampings in the front region of the cards to ensure that the free, bottom-side end of the card hold-back pin comes to rest on the selected index card. In this position the release arm has also reached the front terminal ledge of the drawer, so that on further depressing the selection key the front region of the drawer can be forced downwards via the downward movement of the release arm and the drawer is unlocked, so that the drawer is extended and the selected index card with the in each case underlying cards is moved along, whilst the cards located above the selected card are held back by the hold-back pin in the inner area of the housing.

Due to the fact that all the index cards are frontally provided with the same profile of a selection stamping, it is possible to place the cards in random manner on the drawer. There is no need to insert the index card in a given order. As the selection stampings on the front of the index cards have a wave-like profile, there is no need for engagement openings for the card hold-back pins. The full surfaces of the index cards are available for inscriptions.

Advantageous developments of the invention are characterized in the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 10:
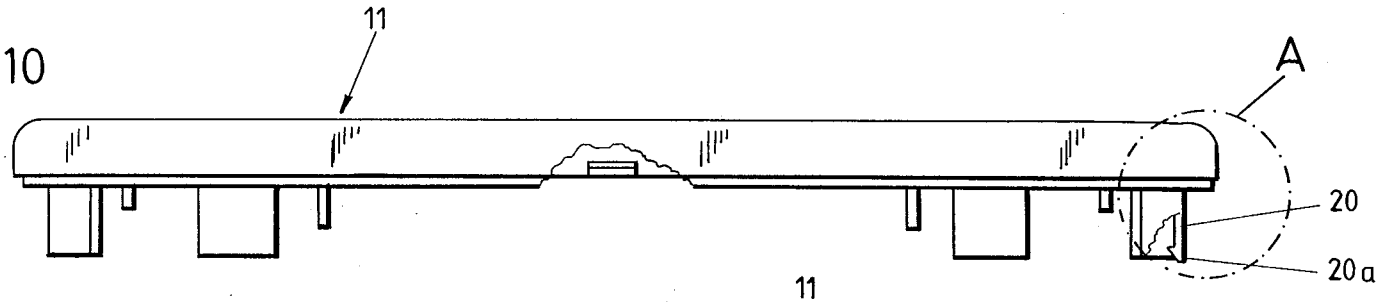
FIG. 10; A front view of the cover part.
Figure 11:
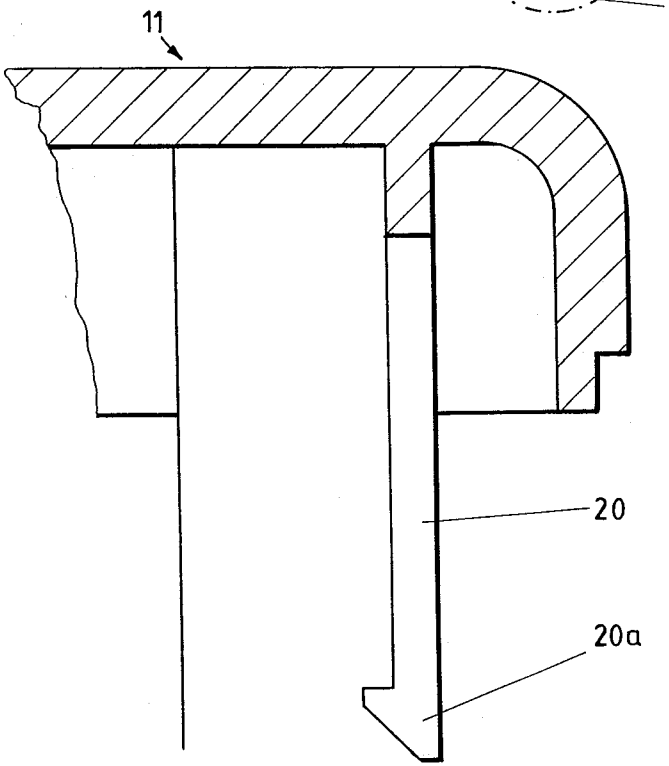
FIG. 11; A larger-scale, vertical section through detail A in FIG. 10.

The telephone index shown in FIGS. 1 to 7 comprises a housing 10 with a box-like cover part 11 and a box-like base part 21. Cover part 11 and base part 21 are joined together by means of screw, adhesive, drop-in or snap connections and are made from plastics or other suitable materials. A drop-in or snap closure is e.g. obtained by means of resilient-elastic tongues or pins, indicated at 20 in FIGS. 8 and 10 and which are provided at their free ends 20*a*, with e.g. a hook-like design engaging in corresponding counterprofiles. The tongue-like connecting elements 20 are fixed to the cover part 11 or are shaped thereon, whilst the counterengagement elements are formed on base part 21.

Figure 1:
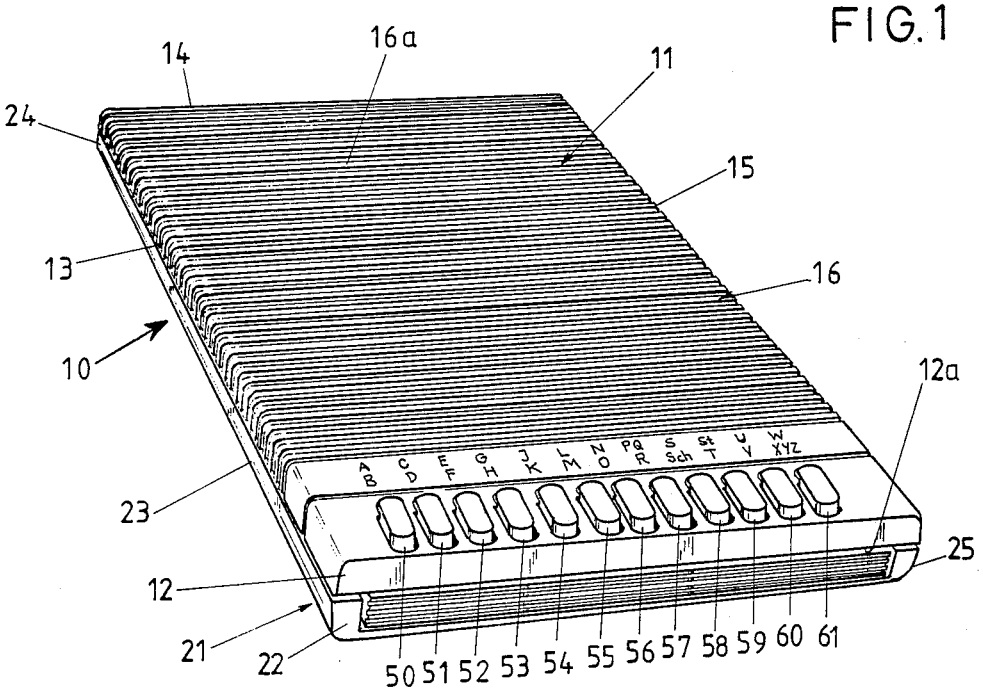
FIG. 1; A diagrammatic view of a telephone index.
Figure 2:
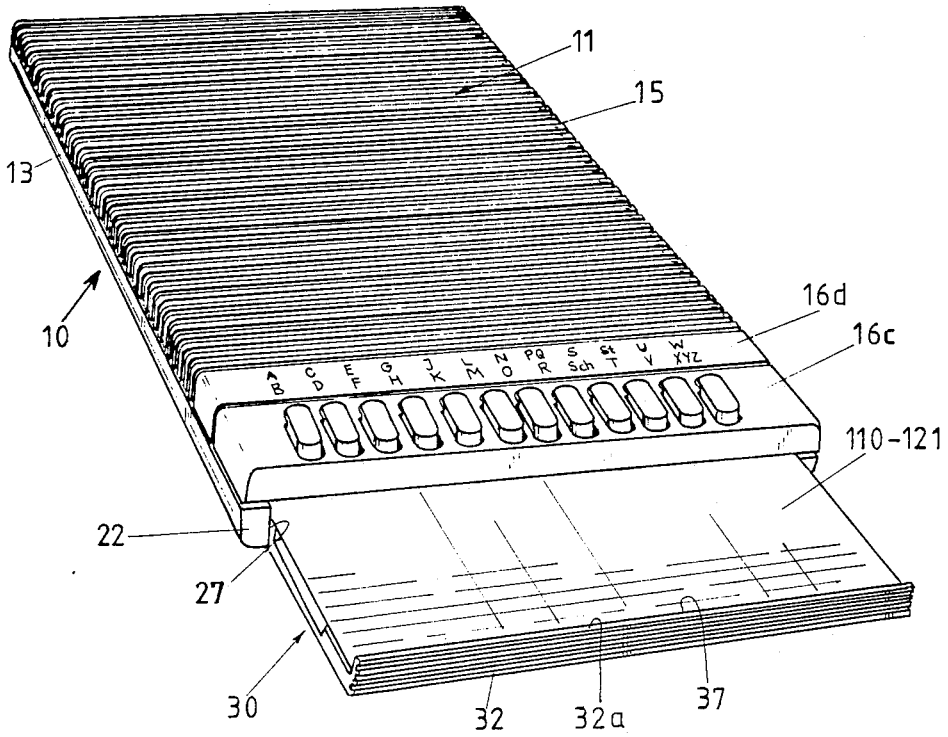
FIG. 2; A diagrammatic view of the telephone index wit extended drawer.
Figure 3:
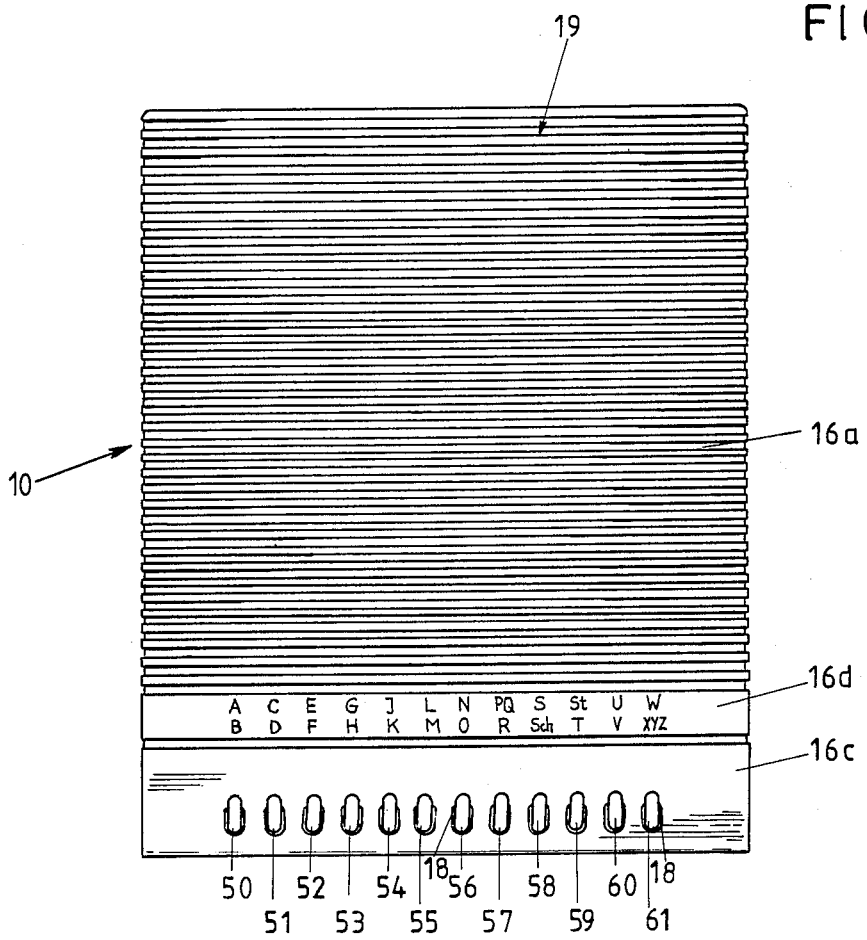
FIG. 3; A plan view of the telephone index.
Figure 4:
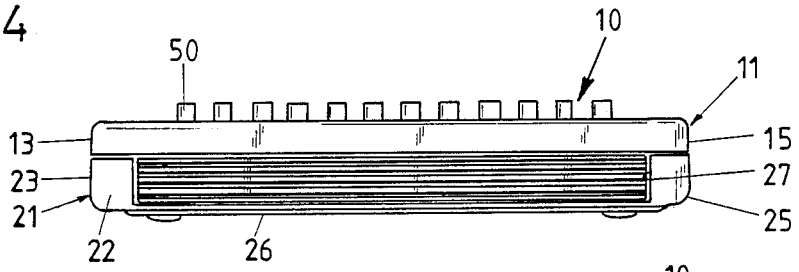
FIG. 4; A front view of the telephone index.
Figure 5:
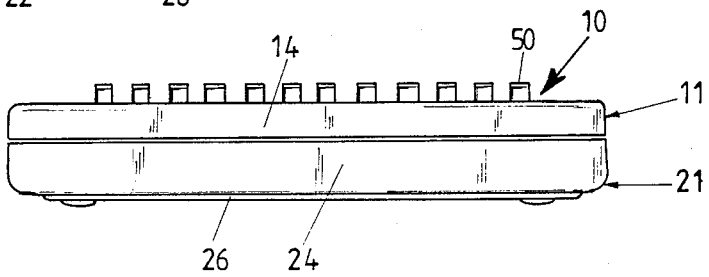
FIG. 5; A rear view of the telephone index.
Figure 6:
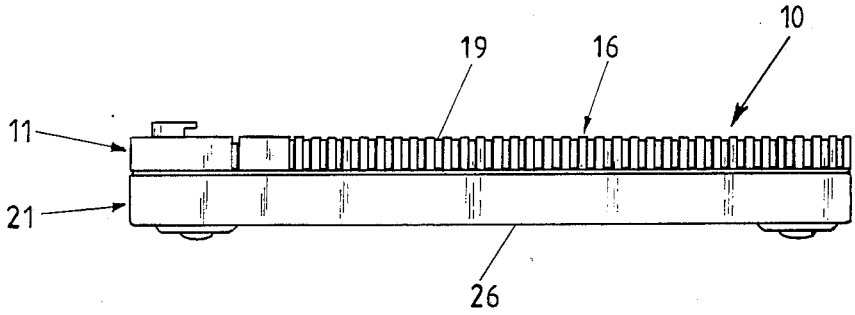
FIG. 6; A side view of the telephone index.
Figure 7:
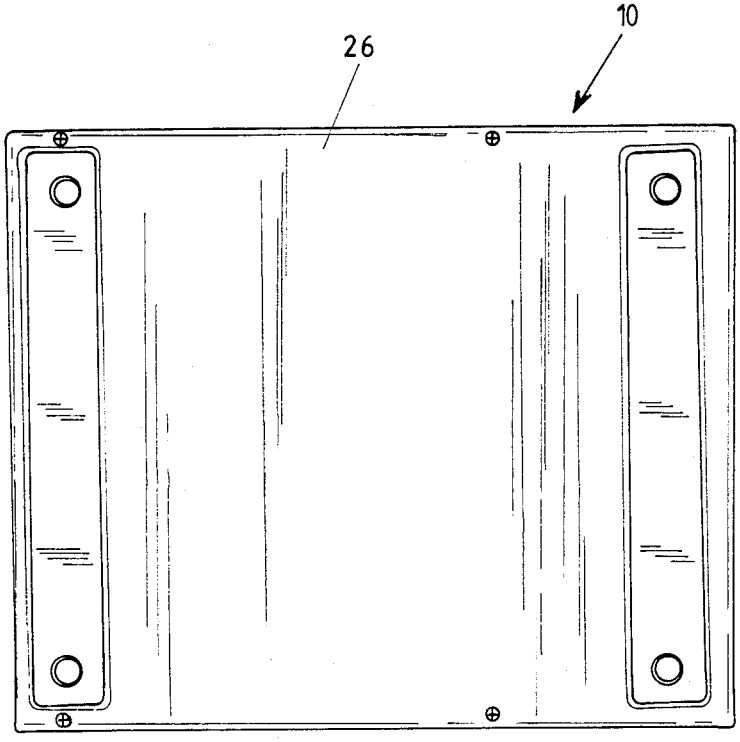
FIG. 7; A view from below of the telephone index.

Cover part 11, its side walls 13, 15, its front wall 12 and its rear wall 14, has an upper cover plate 16 in which, adjacent to front wall 12, is formed a plate portion 16*c*, which is provided with a plurality of juxtaposed openings 18 for receiving and passing through a plurality of selection keys 50, 51, 52, 53, 54, 55, 56, 57, 58, 59, 60, 61 (FIG. 3). The portion 16*a* left alongside portion 16*c* serves as a reception surface for a telephone and has corresponding dimensions. It is also possible to provide between the two cover plate portions 16a, 16c, a further portion 16d, as shown in FIG. 3, which serves to receive symbols, e.g. the letters of the alphabet for marking the selection keys 50 to 61. However, if portion 16c of the upper cover plate 16 of cover part 11 is correspondingly wide, then the symbols can also be placed on portion 16c. The application of these symbols can take place by screen process printing or some other suitable application process, so that the symbols applied can be identified in a completely satisfactory manner even after the telephone index has been in use for many years.

The telephone reception surface 16a of upper plate 16 can be provided with a non-slip covering. In the embodiment of FIGS. 1, 2, 3 and 6 the telephone reception surface 16a is provided with a corrugated or grooved profile 19 running at right angles to the longitudinal direction of the telephone index, said profile 19 extending into the side wall region 13, 15 of cover part 11. It can also be extended into the side wall region of base part 21. As a result of this profile configuration of surface 16a of cover plate 16, a telephone placed on surface 16a is reliably prevented from slipping. When using a grooved profile, the further advantage is obtained that when the profile grooves have a corresponding width, parts of the reception surface 16a can be used for receiving writing implements, such as pencils, ball pens, etc. These writing implements are then securely held in the individual grooves. The corrugated or grooved profile 19 of cover plate 16 also reinforces the latter, so that it can have a limited material thickness, without impairing the inherent rigidity of said cover plate.

Base part 21, its side walls 23, 25, its front wall 22 and its rear wall 24, has a base plate 26 and a slot-like opening 27 in front wall 22, which is used for receiving a drawer 30. This insertion and extraction opening 27 for drawer 30 is indicated in the upper region of front wall 12 of cover part 11, whereby the lower edge of front wall 12 is designated 12a (FIGS. 8, 28 and 29) and is bounded in the lower region by cover plate 26.

Figure 17:
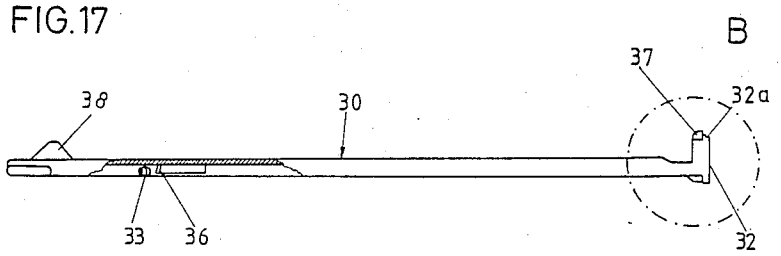
FIG. 17; The drawer in side view and partly in a vertical sectional representation.
Figures 21, 22, 23:
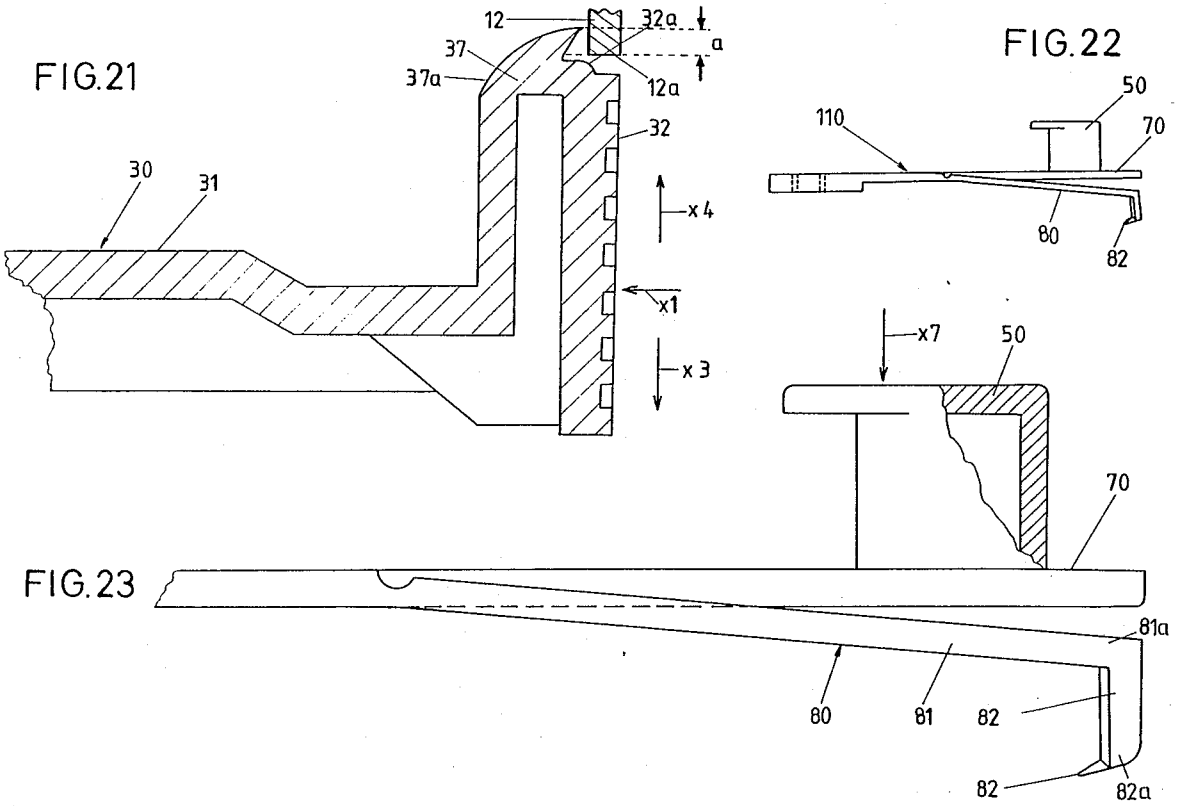
FIG. 21; A larger-scale, vertical section through the front portion of the drawer according to detail B of FIG. 17.
FIG. 22; a side view of a selection key plate with a selection key, a release arm and a card hold-back pin.
FIG. 23; The selection key plate according to FIG. 22 in a larger-scale representation and in part with a vertical section.
Figure 24:
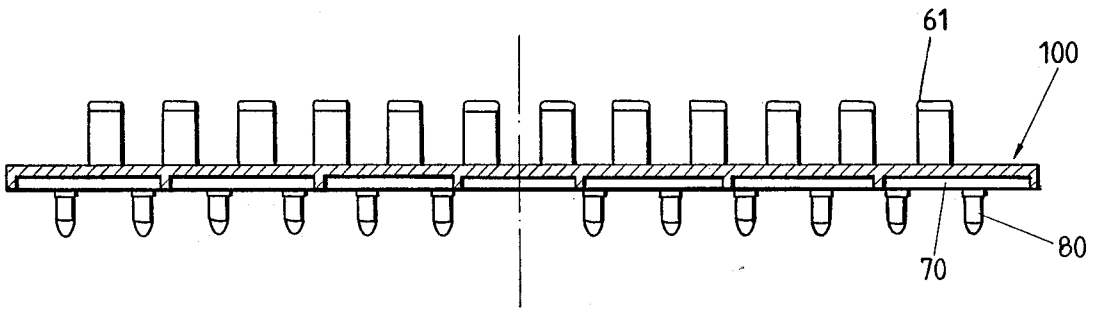
FIG. 24; A front view of the selection key plate.
Figure 25:
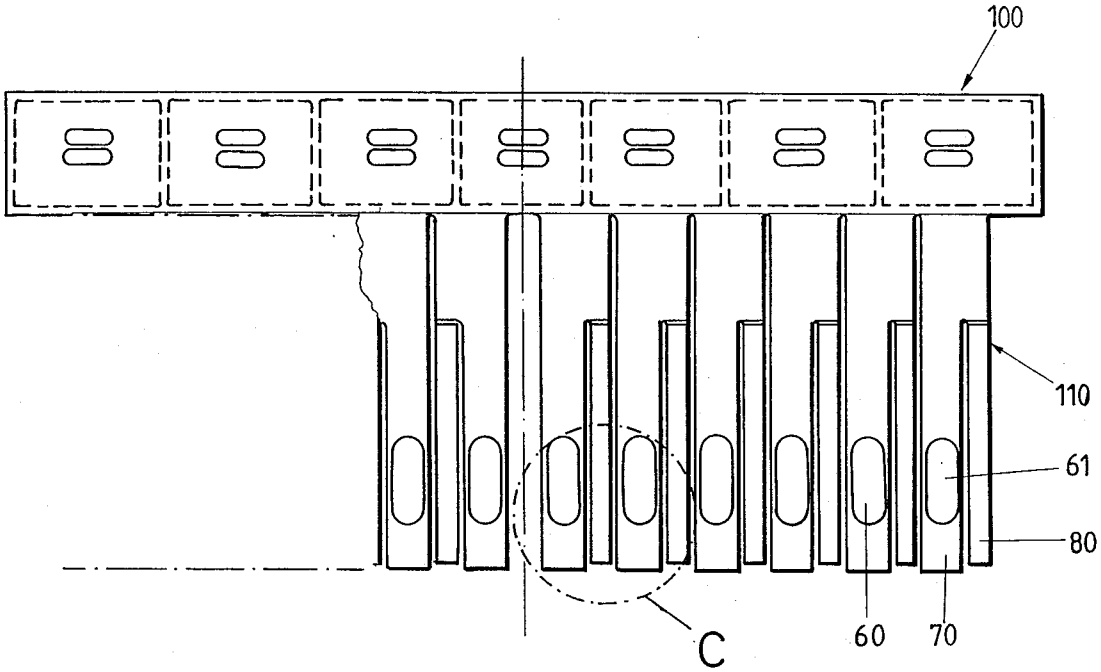
FIG. 25; A plan view of the selection key plate.
Figure 26:
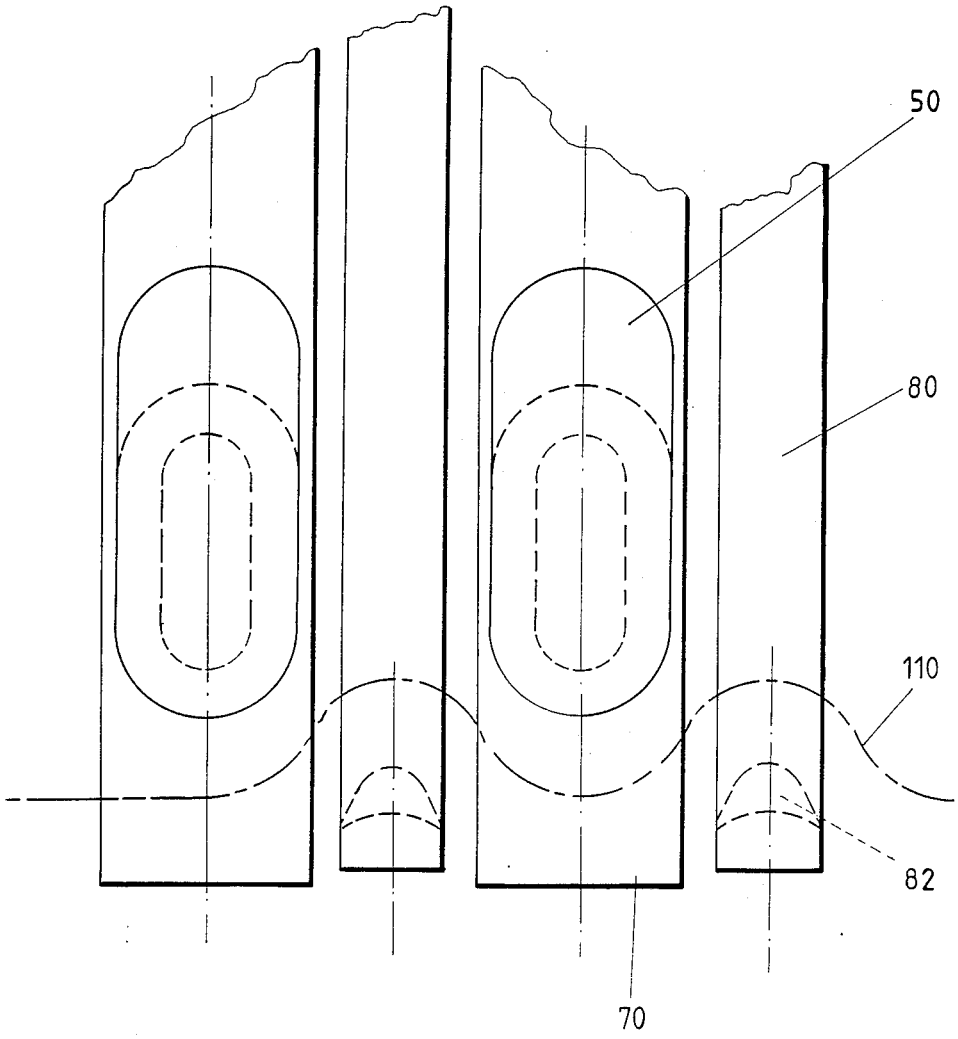
FIG. 26; A larger-scale portion of the selection key plate according to detail C in FIG. 25.
Figure 28:
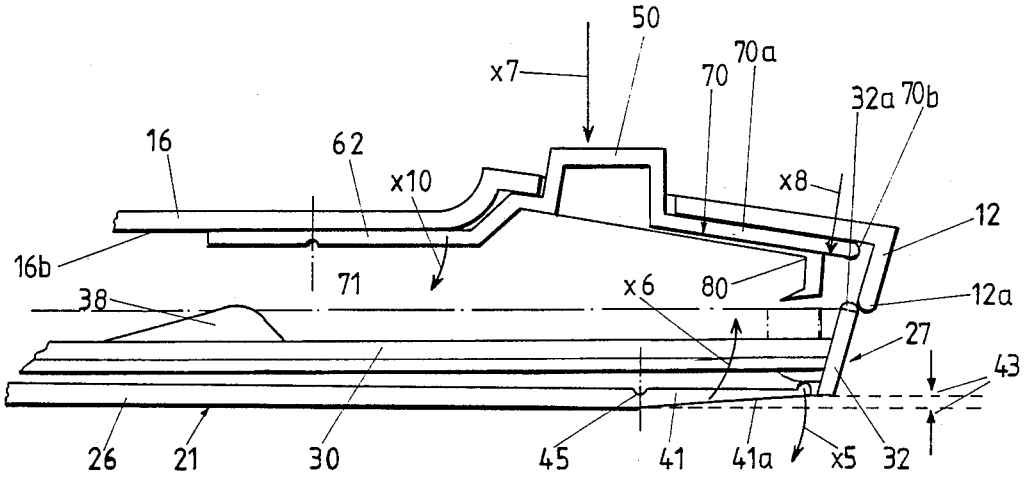
FIG. 28; A diagrammatic side view of the front portion of the telephone index with the inserted, locked drawer.

Base part 21 of housing 10 receives drawer 30, which comprises a plate-like drawer bottom, i.e. the index card stack reception plate 31 and a front terminal ledge 32, which closes the drawer extension opening 27 in the front wall 22 of base part 21 when drawer 30 is inserted. The upper edge of terminal ledge 32 is designated 32a (FIG. 17, 21 and 28). Drawer 30 is held and guided on base plate 26 of base part 21 by means of lateral guidance webs, so that a completely satisfactory extension and retraction of the drawer are ensured. Drawer 30 is open at the sides and rear and only in the front region has the terminal ledge 32, by means of which the drawer extension opening 27 can be closed when drawer 30 is introduced into the interior of housing 10.

Figure 12:
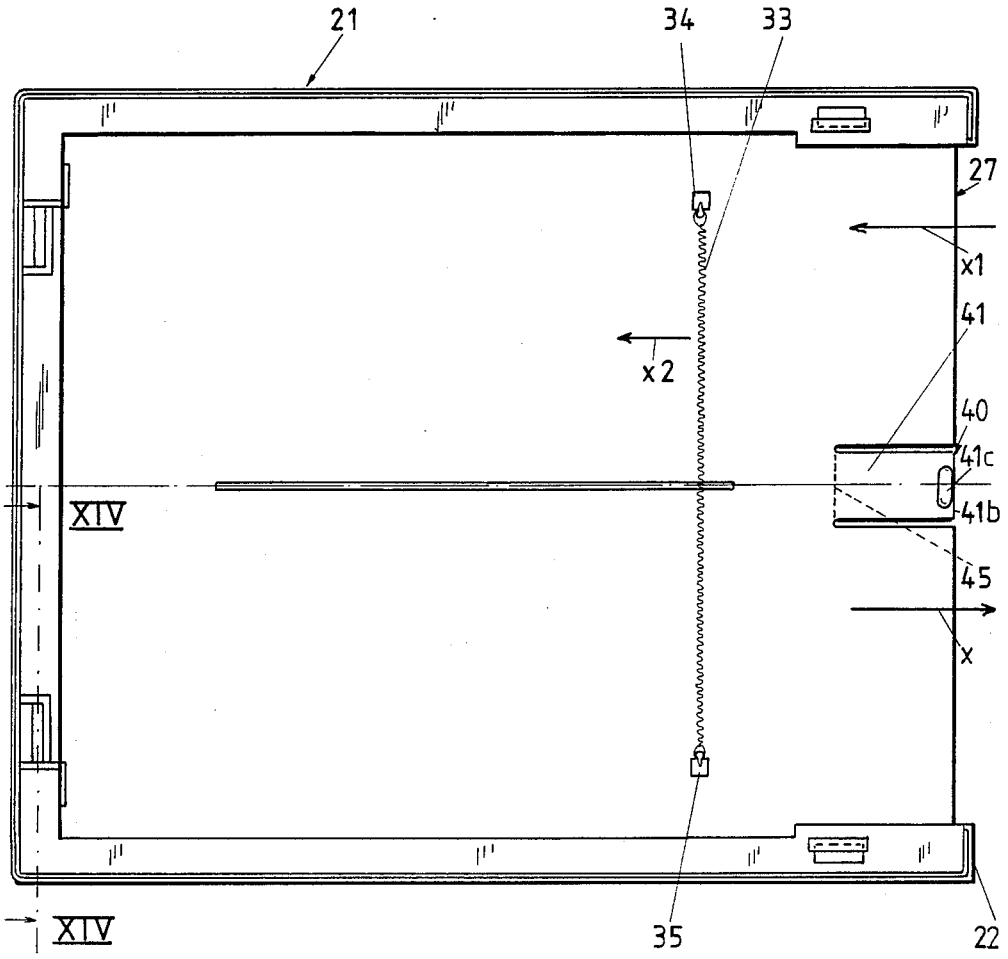
FIG. 12; A plan vie of the base part of the telephone index housing.
Figure 13:
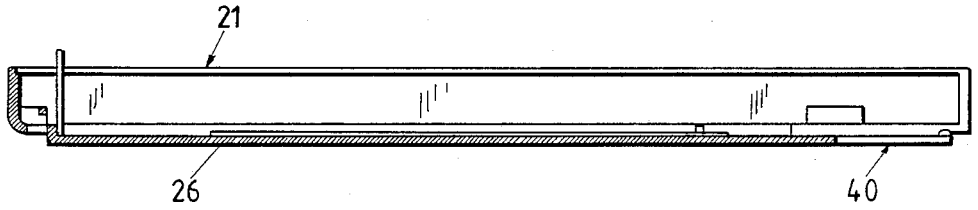
FIG. 13; A vertical longitudinal section through the base part.
Figure 14:
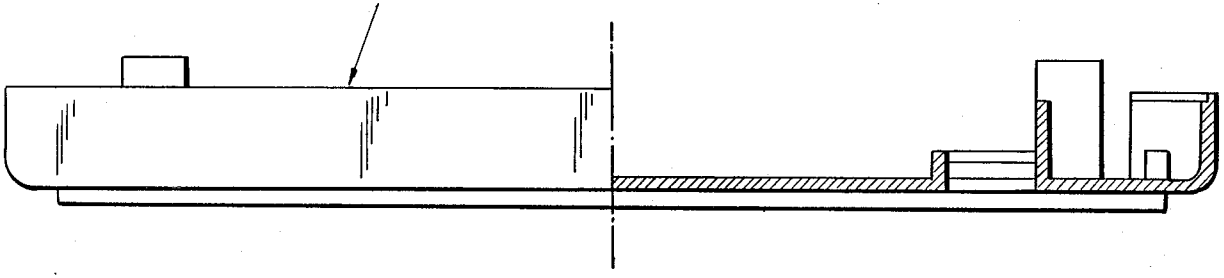
FIG. 14; A half-section along line XIV—XIV of FIG. 12.
Figure 15:
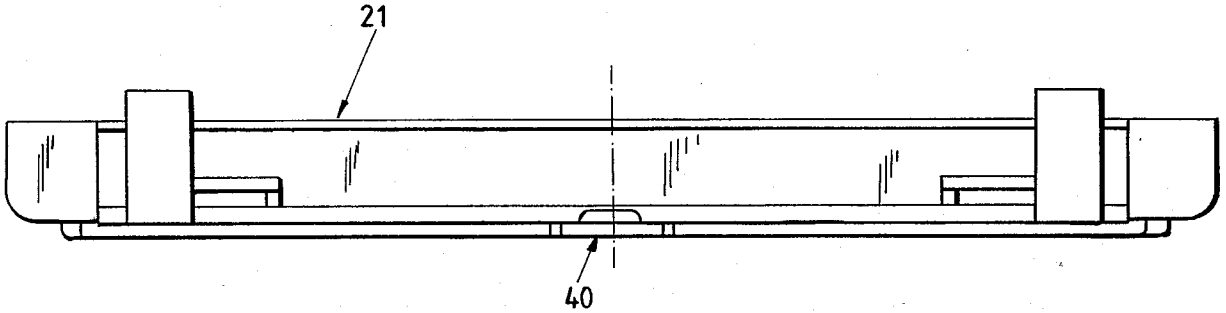
FIG. 15; A front view of the base part.
Figure 16:
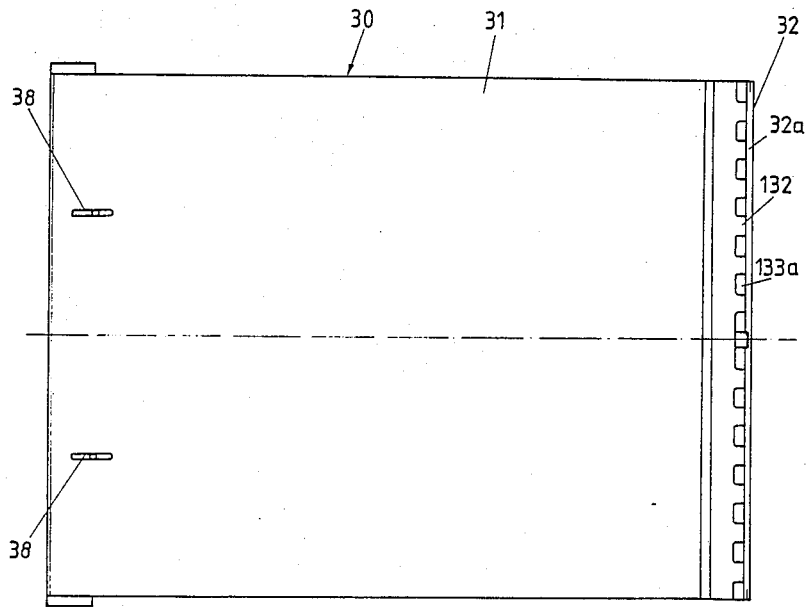
FIG. 16; A plan view of the drawer.

On base plate 26 of base part 21, a spring 33 acting on the drawer 30 is provided for the extension of the latter and is constituted by a spiral spring tensioned above base plate 26 of base part 21 of housing 10 at right angles to the drawer extension direction and indicated by arrow X in FIG. 12, the ends of the spring being fixed at 34, 35 to base plate 26 of base part 21 using connecting hooks (FIG. 12). Preferably spiral spring 33 is arranged on the base plate 26 of base part 21 in the front third thereof. If drawer 30 is inserted in housing 10 in arrow direction X1, then spiral spring 33 is engaged by cam 36 on the underside of the index card stack reception plate 31 of drawer 30 and on further insertion of the latter is moved in arrow direction X2 and is thereby tensioned. When drawer 30 is locked in the housing and unlocking takes place, then drawer 30 is automatically moved out of the interior of housing 10 by means of the spring tension obtained as a result of the tensioned spring 33. Spiral spring 33 can be replaced by a differently constructed, but appropriate spring element. Thus, it is possible to place on base plate 26 of base part 21 a steel spring rod not shown in the drawing, in such a way that its one free end is connected to the index card stack reception plate 31, whilst the other end is connected to base plate 26 of base part 21. The action of the steel spring corresponds to spiral spring 33, which is placed under tension when drawer 30 is inserted into base part 21 of housing 10, so that when drawer 30 is unlocked, it is extended by means of the steel spring rod springing back into its starting position.

For locking drawer 30 when inserted in housing 10, on the upper edge 32a of terminal ledge 32 of drawer 30 and in fact centrally on said ledge, is shaped a locking cam 37 (FIG. 21). In its upper region, locking cam 37 has chamfered portion 37a, which runs towards the rear of drawer 30 in chamfered manner or, as shown in FIG. 21, in arcuate manner, so that said portion 37a constitutes an abutting surface when drawer 30 is inserted in arrow direction XI into the interior of housing 10. Since, as will be described in greater detail hereinafter, drawer 30 with its front region is held in a raised position by means of a spring element 40, so as to achieve locking of drawer 30 in the inserted state, it is advantageous if surface 37a of locking cam 37 is arcute, as shown in FIG. 21. Thus, on inserting drawer 30 into the interior of housing 10, said arcuate surface 37a of locking cam 37 can slide past the lower edge 12a of front wall 12 of cover part 11. This is possible because the front region of drawer 30 is lowered with respect to spring element 40 in arrow direction Y3, so that locking cam 37 can be moved past below edge 12a of front wall 12 of cover part 11. As spring element 40 attempts to oppose the pressure exerted by the spring element with a counterpressure, the front region of drawer 30 is raised in arrow direction X4 by the relaxing or expanding spring element 40, so that then the locking cam 37 comes to rest on the inner wall surface of front wall 12 of cover part 11, as shown in FIG. 21. Maintaining drawer 30 with its front region in the raised position takes place by means of a resilient-elastic portion 41, which is constructed as a spring element 40 and which keeps the drawer 30 with its front region in a raised position, in such a way that the locking cam 37 engages in locking manner on the lower edge 12a of the upper front wall 12 of cover part 11 which at the top bounds the drawer extension opening 27.

Figure 29:
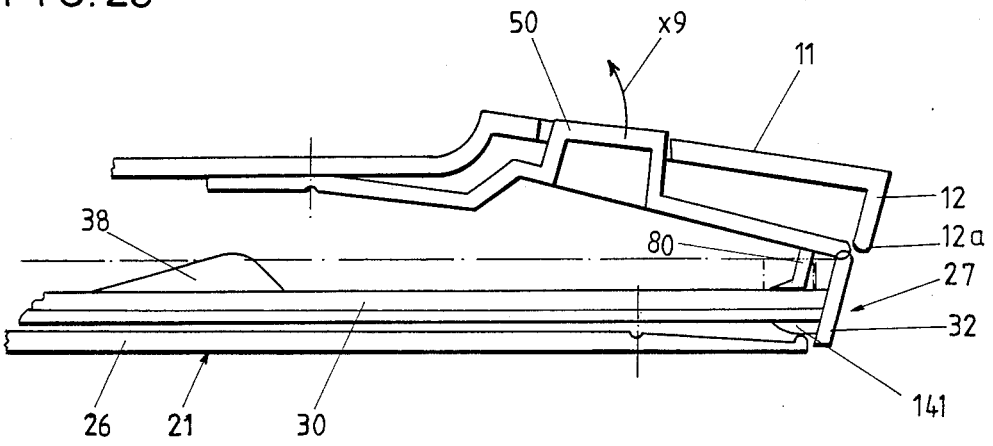
FIG. 29; A diagrammatic side view of the front portion of the telephone index during the operation of a selection key.
Figure 30:
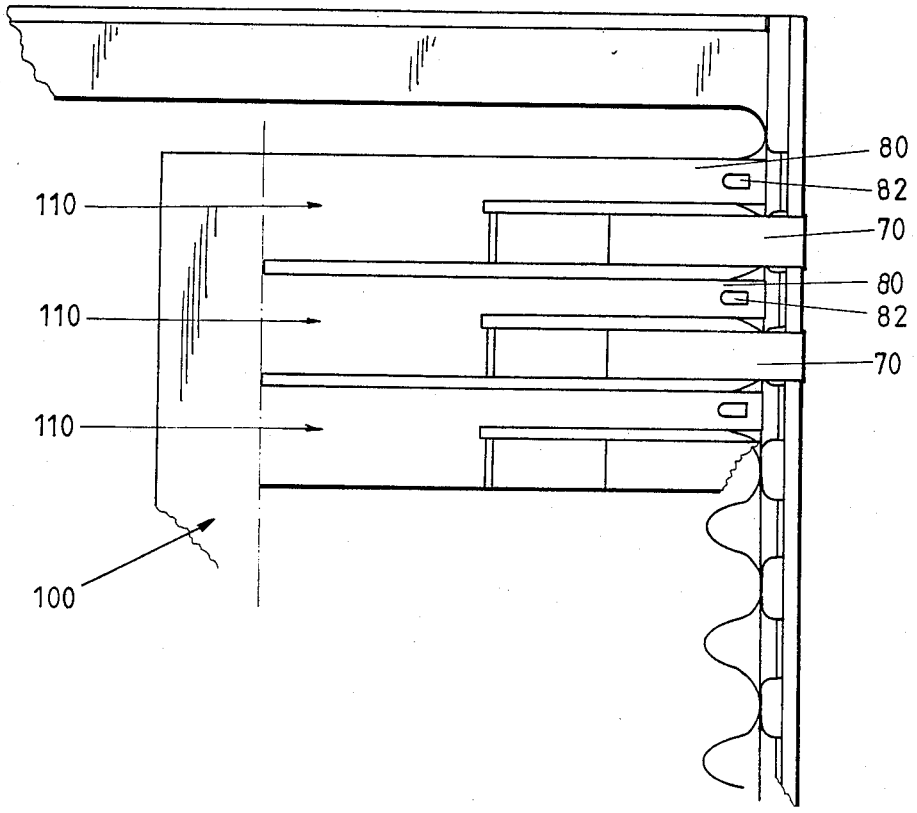
FIG. 30; A plan view of a portion of the selection key plate.

Spring element 40 acting on the front region of drawer 30 comprises a resilient-elastic portion 41, which in the front region of base plate 26 of base part 21 is stamped from the base plate material and is constructed as a spring tongue-like element, which is connected at one end to base plate 26 (FIGS. 12, 28 and 29). The free end of the resilient-elastic portion 41 has a raised position when drawer 30 is inserted. If, on inserting into housing 10 so as to be transferred to the locking position, drawer 30 is forced in the direction of base plate 26 of base part 21, then the resilient-elastic portion 41 is also pressed downwards in arrow direction X5 (FIG. 28) and as soon as drawer 30 has assumed the locking position shown in FIGS. 21 and 28, the elastic portion 41 automatically springs back in arrow direction X6, so that drawer 30 is held in its locked position.

Base plate 26 of base part 21 is made from a suitable plastics material, so that portion 41 has resilient-elastic properties and a high recovery capacity. Portion 41 in base plate 26 of base part 21 can extend roughly over the entire width of base plate 26. In the embodiment according to FIG. 12 the resilient-elastic portion 41 is formed centrally and in the front region of base plate 26 of base part 21. By means of a film hinge 45, resilient-elastic portion 41 is connected to base plate 26 of base part 21. Film hinge 25 is manufactured at the same time as base plate 26 of base part 21 or base part 21 in conjunction with the construction of the resilient-elastic portion 41 and is formed by a material reduction in the bending region. If e.g. polypropylene is used as the plastic, then a plastic hinge with extremely good bending strength is obtained. However, it is important that in its basic position the resilient-elastic portion has a slightly inclined position, i.e. its free end is raised, so that the front region of drawer 30 can be raised to bring about locking. In place of a single resilient-elastic portion 41 in base plate 26 of base part 21, several juxtaposed resilient-elastic portions 41 can be formed therein.

According to another embodiment shown in FIGS. 12, 28 and 29, the front, free end 41*b* of the resilient-elastic portion 41 has a bead-like thickened part at 41*c*, which cooperates with a sliding cam 141 on the front under side of the drawer base plate 31 on inserting drawer 30, so as to increase the tension of portion 41 and simultaneously its resilient action, as well as the contact pressure directed upwards against drawer 30. The bottom wall surface 41*a* of resilient-elastic portion 41 is constructed in sloping manner towards its free, front end 41*b*, as shown in FIG. 28, i.e. the bottom wall surface 41*a* conically tapers towards free end 41*b*, so that between the free end 41*b* and the plane formed by the underside of base plate 26 of base part 21 a spacing or gap 43 is formed and which is dimensioned in such a way that on depressing the front region of drawer 30, the resilient-elastic portion 41 can be pressed into said gap in order to unlock drawer 30, as shown in FIGS. 28 and 29.

In place of the spring elements 40 described hereinbefore and shown in the drawing, it is also possible to use differently constructed elements, but they must be resilient-elastic so that as a result of their resilience or spring tension the drawer 30 can be held in the raised position for locking purposes (FIG. 28), but it is also necessary for the spring element to be compressed on pressing down the front region of drawer 30, so that unlocking of said drawer is possible. If the pressure exerted on the spring element is then removed, the said element must be able to automatically move back into the starting position, as shown in FIG. 28. All types of spring elements attaining this action can be used.

Figure 18:
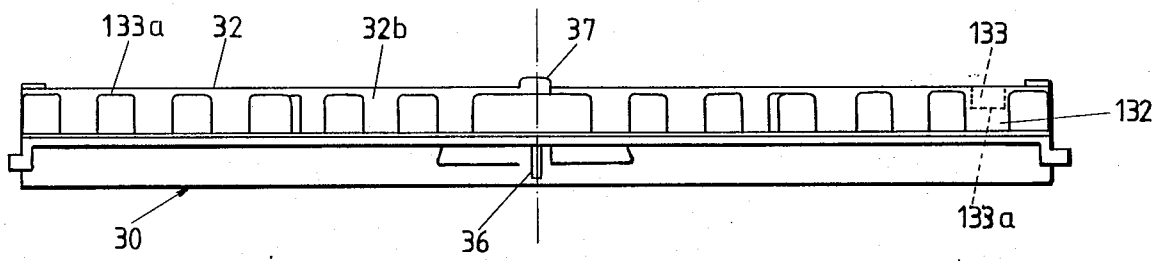
FIG. 18; A view of the inner wall surface of the front terminal ledge of the drawer.
Figure 19:
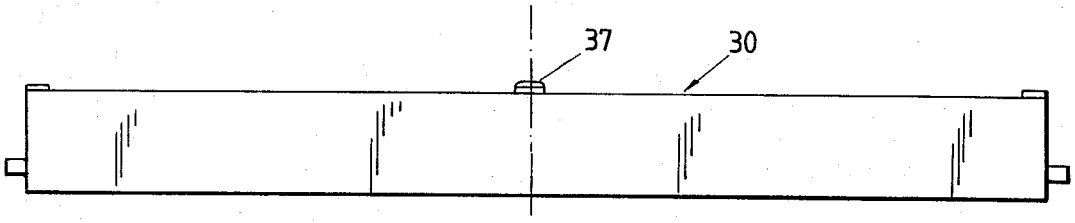
FIG. 19; A front view of the front terminal ledge of the drawer.
Figure 20:
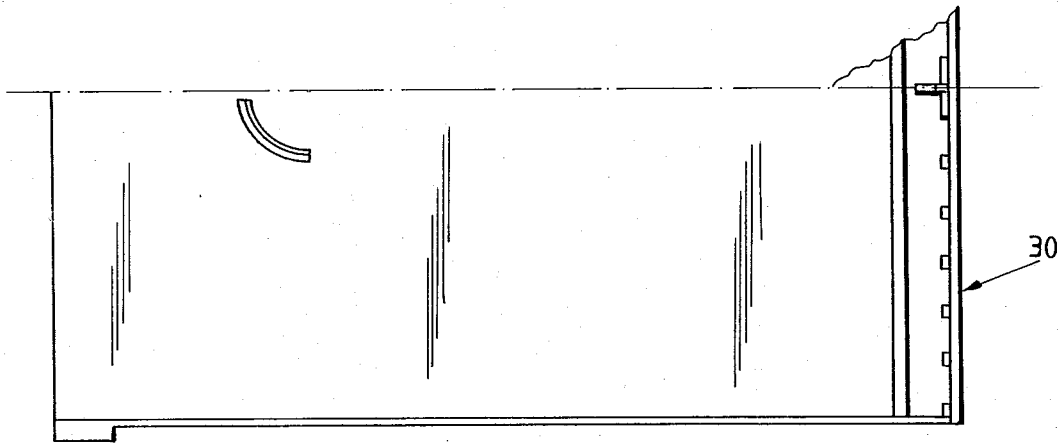
FIG. 20; A view from below of the drawer.

The unlocking of the inserted drawer 30 and the selecting of the individual index cards is controlled or carried out by selection keys 50 to 61. Each selection key 50 to 61 is linked with a release arm 70, which is in turn in operative connection with a card hold-back pin 80 to be described hereinafter. Release arm 70 and hold-back pin 80 form a unit 110, with each of which is associated a selection key, so that the number of units 110, in each case comprising a release arm 70 and a card hold-back pin 80, corresponds to the number of selection keys. In the embodiment shown in the drawing the telephone index has twelve selection keys 50 to 61. There is then a corresponding number of units 110. The selection key associated with each unit 110 is connected thereto, i.e. the selection key is an integral component of unit 110 and is shaped on release arm 70 which in its fixing region is constructed in resilient-elastic manner on cover plate 16 of cover part 11 and is pivotable in the direction of arrow x10 about hinge 71, so that a resilient-elastic action is obtained. Release arm 70 with selection key 50 is so arranged on the inner wall surface 16*b* of the upper cover plate 16 of cover part 11, that on depressing selection key 50 in arrow direction x7, the free-front portion 70*a* forming release arm 70 is pivotable in the direction of arrow x8 towards the bottom of housing 10 (FIG. 28), but immediately springs back into its initial position when the pressure on the selection key is removed. Unit 110 formed from release arm 70 and card hold-back pin 80 is made from resilient-elastic plastics, which have a high recovery capacity, so that selection key 50 moves automatically back from its pressed in position shown in FIG. 29 into its initial position shown in FIG. 28. This moving back of selection key 50 occurs in the direction of arrow x9. During this return movement of selection key 50 release arm 70 connected to the selection key is moved from the position shown in FIG. 29 back into the position shown in FIG. 28. Portion 70*a* representing release arm 70 is not resilient-elastic and instead has an adequate inherent rigidity to ensure that it does not bend when operating selection key 50 in the direction of arrow x7. The length of release arm 70 is such that on depressing selection key 50 in the direction of arrow x7, the front-free end 70*b* of arm 70 strikes against the upper edge 32*a* of terminal ledge 32 of drawer 30 (FIG. 29). Preferably the front terminal ledge 32 of drawer 30 is provided on its inner wall surface 32*b* with a shaped ledge 132, which serves as a bearing surface for the operated release arms 70. Ledge 132, which can have a height corresponding to that of terminal ledge 32, has a number of recesses 133 corresponding to the number of release arms 70. Each recess has at the bottom a bearing surface 133*a*, so that on operating a selection key the release arm 70 connected thereto engages the bearing surface 133*a* of ledge 132 with terminal ledge 32 of drawer 30, so that the front region of drawer 30 is forced out in the direction of the bottom of housing 10 (FIG. 18). However, it is also possible to have a different design of the impact surface for release arms 70 on terminal ledge 32 of drawer 30. As is also shown in FIG. 18, by a corresponding profiling of inner wall surface 32*b* of terminal ledge 32 of drawer 30, a construction of bearing surfaces 133*a* is obtained, it being important that bearing surfaces 133*a* are located below the upper edge 32*a* of terminal ledge 32, so that the free ends of the release arms 70 do not come to rest directly on the upper edge 32*a* of ledge 32 on operating a selection key and instead are located in a region adjacent to the upper edge, because the front wall surface of terminal ledge 32 passes continuously into the wall surface of front wall 12 of cover part 11.

The card hold-back pin 80 cooperating with release arm 70 is constructed in advancing or leading manner, as shown in FIGS. 22 and 23 and as will be described hereinafter. Each card hold-back pin 80 comprises a tongue-like portion 81, which can have a resilient-elastic construction and which at its free, front end 81*a* has a roughly vertical portion 82 bent in the direction of base plate 26 of base part 21 and which carries at its free, bottom end 82*a* a card supporting surface 82 directed into the rear region of housing 10 and which, as shown in FIG. 23, has a hook or clasp-like construction. Release arm 70 with its card hold-back pin 80 is so held and fixed on the inner wall surface of the upper cover plate 16 of cover part 11, that on depressing e.g. selection key 50 release arm 70 with pin 80 is pivoted downwards about the hinge point 71 in the direction of arrow x6 and after removing the pressure exerted on selection key 50, release arm 70 with key 50 and hold-back pin 80 automatically springs back into its upper initial position (FIG. 28) due to the resilient-elastic design and the choice of a suitable plastic.

Figure 8:
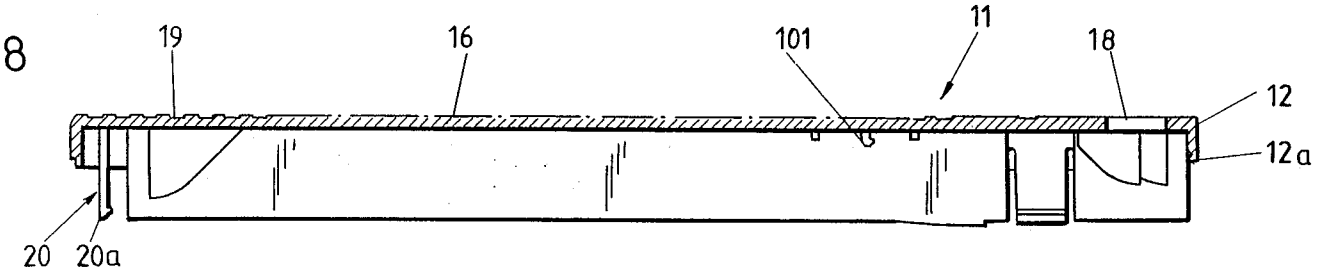
FIG. 8; A vertical longitudinal section through the cover part of the telephone index housing.
Figure 9:
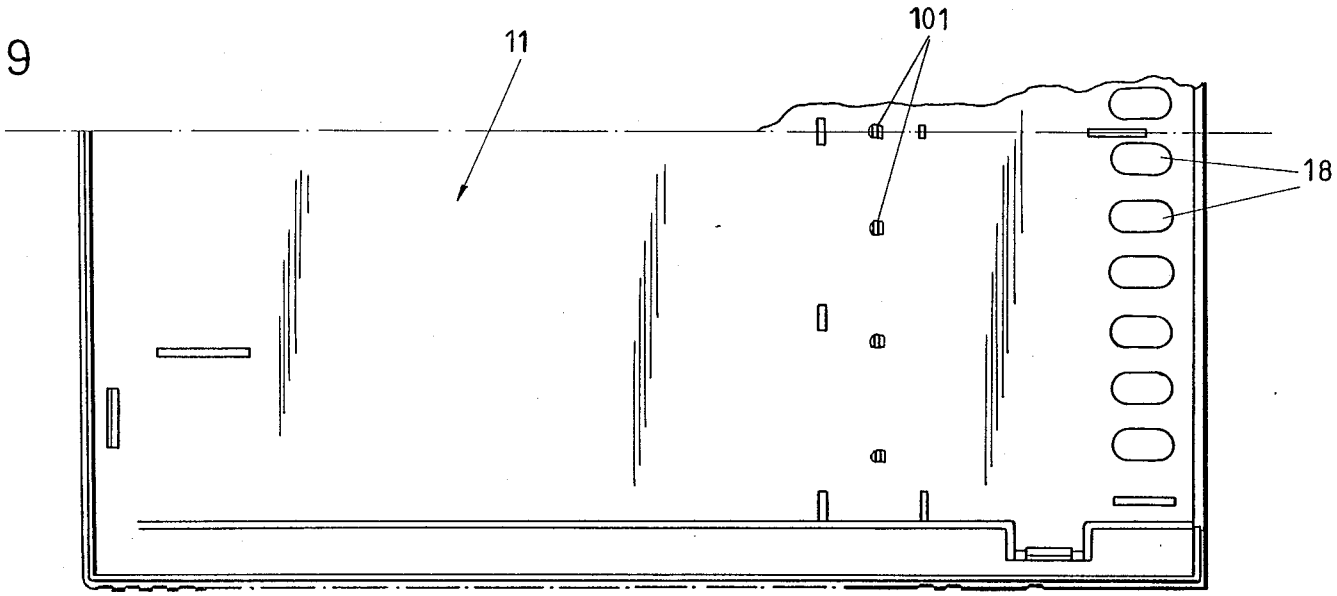
FIG. 9; A view from below of a portion of the cover part.

All the units 110, each of which comprises a release arm 70 and card hold-back pin 80, are combined in a selection key plate 100 (FIGS. 24, 25, 26 and 30). This selection key plate 100 is fixed to the inner wall surface 16*b* of upper cover plate 16 of cover part 11 by means of hook-like pins shaped onto cover plate 16 (FIGS. 8 and 9). Selection key plate 100 can be fixed to cover part 11 by means of per se known drop-in or snap connections, but it is also possible to use other connecting means, such as screw or adhesive connections. The arrangement of the selection key plate 100 on the inner wall surface of cover plate 16 of cover part 11 takes place in such a way that selection keys 50 to 61 pass through the openings 18 in upper cover plate 16 of cover part 11, so that release arm 70 comes to rest on the inner wall surface of the front portion of cover plate 16. It is also possible to construct the portion of cover plate 16 of cover part 11 carrying the selection keys in console-like manner and as shown in FIGS. 28 and 29.

Figure 27:
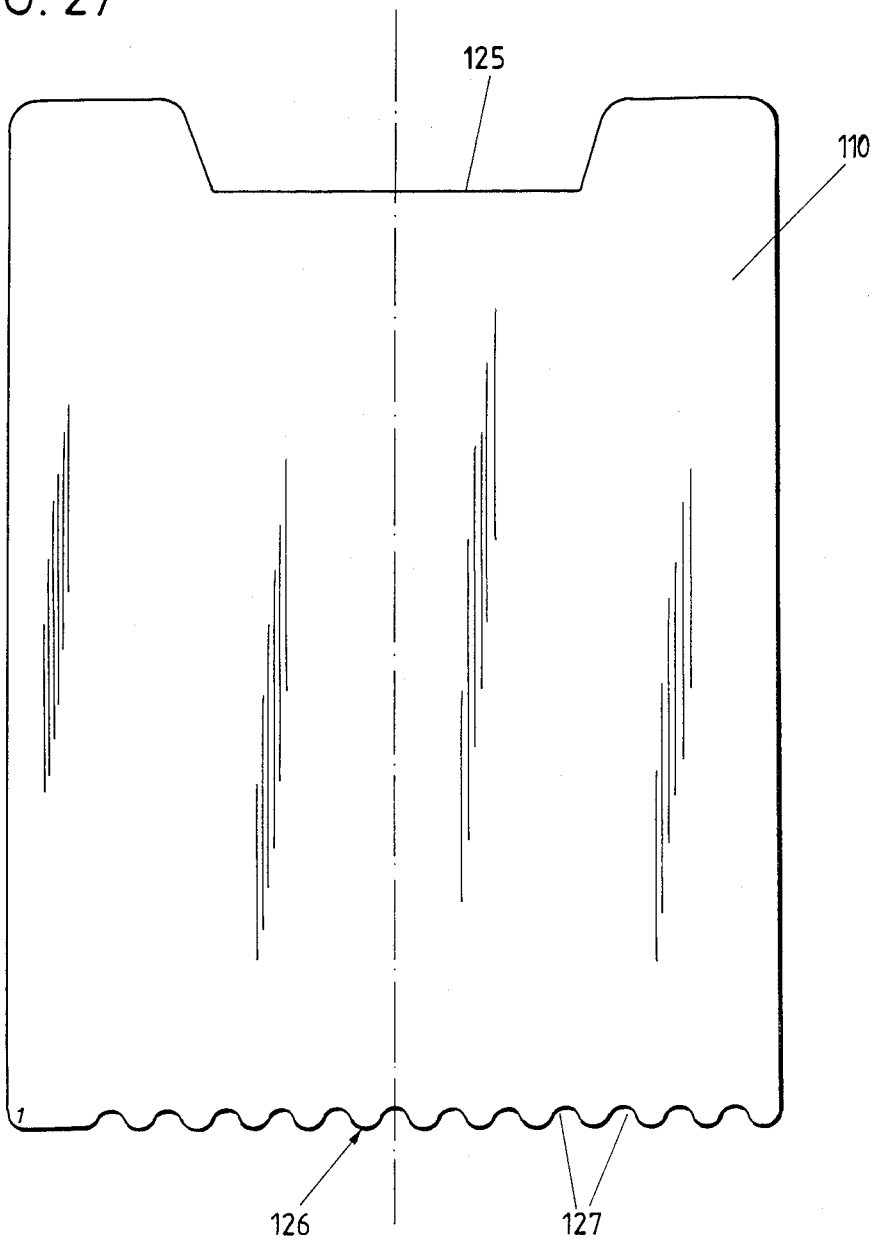
FIG. 27; A plan view of an index card.
Figures 27A, 27B, 27C, 27D, 27E, 27F, 27G, 27H, 27I, 27J, 27K:
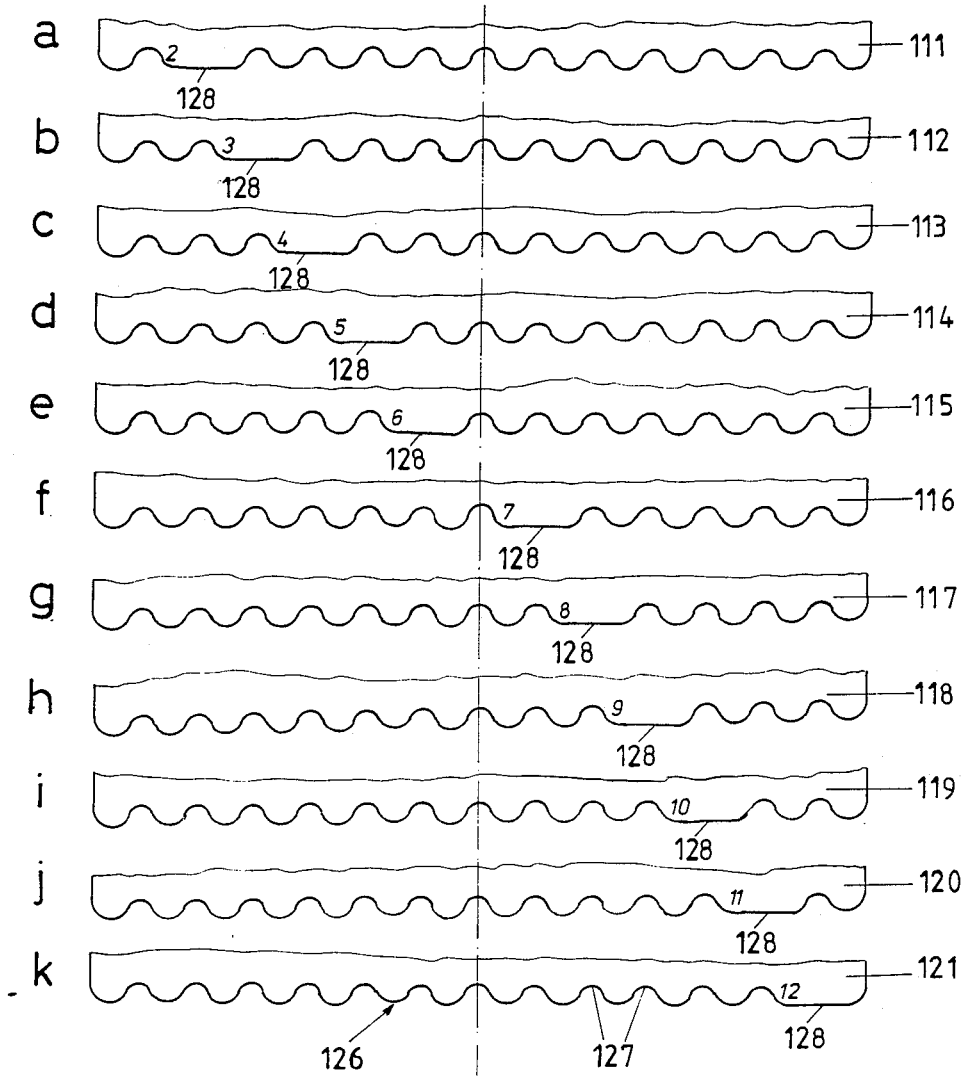
FIG. 27*a* to 27*k*; Plan views of the front portions of a further eleven index cards provided with selection stampings.

Drawer 30 receives a stack of index cards. In the embodiments shown in the drawing one index card is associated with each selection key 50 to 61. The index cards are designated 110, 111, 112, 113, 114, 115, 116, 117, 118, 119, 120, 121 (FIGS. 27, 27*a* to 27*k*) and all have an identical construction. In the rear region thereof is provided a driving stamping 125 which, as shown in FIG. 27, extends over a larger area. In addition, each index card is provided in its front region with a selection stamping 126 in the form of a wave profile, whose individual recesses are designated 127. When carrying out a selection process, the card hold-back pin 80 of the particular selected key engages in the particular recess 127 of selection stamping 126. As shown by the front portions of the index cards shown in FIGS. 27*a* to 27*k*, cards 111 to 121 are provided in their front region with a longer portion, which extends from one side of the card stack to the other side thereof between the individual cards. Portion 128 is not absolutely necessary. All the index cards can be provided with the wave-like selection stamping 126. There is no need to adhere to a particular order on inserting the cards in drawer 30 as a result of this construction. The wave profile of the card selection stamping 126 is such that when the card stack is placed on drawer 30, recesses 127 and portions 128 come to rest in the movement path of the card hold-back pins 80.

The rear driving stampings 125 is used for the engagement of a driver 38 shaped onto the rear region of the index card stack reception plate 31. The number of rear drivers 38 can be chosen at random. There are preferably two spaced drivers. On extending drawer 30, the rear drivers 38 through engaging in the rear driving stampings 125 take with them both the selected index card and the underlying index cards, whereas the cards located above the selected card are guided over the advancing driver 38 and due to the fact that the cards located above the selected card are held back by the card hold-back pin 80 of the particular operated selection key, said index cards cannot participate in the drawer extension process.

Selection keys 50 to 61 are correspondingly marked with the letters of the alphabet in such a way that selection key 50 carries letters A, B, selection key 51 letters C, D, selection key 52 letters E, F, selection key 53 letters G, H, selection key 54 letters J, K, selection key 55 letters L, M, selection key 56 letters N, O, selection key 57 letters P, Q, R, selection key 58 letters Sch, selection key 59 letters St, T, selection key 60 letters U, V, and selection key 61 letters W, X, Y, Z. The index cards, which are made from cardboard, paste board, etc., can be provided with corresponding line guides, fields, etc. and carry those letters corresponding to the letters of the alphabet associated with the selection keys.

The telephone index functions a follows. On depressing a selection key, e.g. selection key 50 in arrow direction x7, simultaneously release arm 70 and card hold-back pin 80 are depressed, the latter being constructed so as to be in advance of release arm 70, as shown in FIGS. 22 and 23. This advancing design of card hold-back pin 80 with respect to release arm 70 is achieved by a corresponding shaping of the selection key plate 100 with release arms 70 and hold-back pins 80. Before the front, free end 70*b* of release arm 70 strikes against the front terminal ledge 32 of drawer 30, which is located in the telephone index housing 10, card hold-back pin 80 with its card butting surface 82 has reached the selected index card and engages with portion 128 thereof and above which are located the recesses 127 of those index cards which are positioned above the selected card and simultaneously with said impact time release arm 70 has reached a position such that the terminal ledge 32 of drawer 30 is engaged in such a way that drawer 30 in its front region is pressed downwards against spring element 40, so that drawer 30 is unlocked, in that the locking cam 37 engaging on the upper edge of terminal ledge 32 of drawer 30 is pressed down until cam 37 is located below edge 12*a* of front wall 12 of cover part 11. At this incident drawer 30 is unlocked and is extended from the housing by means of spring tension. During the depression of the front region of drawer 30, the resilient-elastic portion 41 is pressed downwards of compressed in arrow direction x5, e.g. in the case that it is a helical compression spring or a conical spiral spring. In the first extension phase of drawer 30 following the unlocking thereof, the index cards located above the selected index card run on the card abutting surface 82 of card hold-back pin 80 or the latter engages with its hook-like abutting surface 82 below all those index cards which are positioned above the selected card, so that said cards are prevented from moving out together with drawer 30 (FIG. 28).

For the manual insertion of drawer 30 into housing 10, the front region of drawer 30 is pressed just in front of front wall 12 of cover part 11 downwards against spring element 40 to such an extent that the locking cam 37 cn slide past below edge 12*a* of front wall 12 of cover part 11. Due to the recovery capacity of spring element 40 or resilient-elastic portion 41, drawer 30 is raised to such an extent in its front region, that locking cam 70 comes to rest behind the front wall 12 of the cover part and consequently locks the drawer and is prevented from automatically being extended out of housing 10 (FIGS. 28 and 29).

For the holding and quasi-locking of drawer 3 in housing 10 when inserted, the aforementioned mechanical elements and spring element 40 need not exclusively be used. According to another embodiment of the invention, the drawer can be held in the raised position in the front region thereof by means of magnetic forces. Through the use of a magnet and a plate or the like made from magnetizable materials, e.g. steel, it is possible to build up a magnetic field with which the drawer 3 is held in housing 10 in the raised position. A front stop or locking cam 37 locking the drawer is then rendered superfluous. On operating a selection key the drawer with its front region is pressed downwards and is therefore lowered, so that the plate is released from the magnets and the drawer is forced out of the housing by means of spring tension. The magnetic field or magnetic forces holding the drawer in the raised position are designed in such a way that on the one hand the drawer is secured counter to the spring or spring tension bringing about extension and on the other hand on operating the selection key the drawer can be raised by the magnets in order to extended. Thus, adequate dimensions must be given to the area in which the front region of the drawer is lowered. On the cover part 11 of housing 10 is consequently provided a magnet, whilst the front region of drawer 3 carries a plate, body or the like, made from a magnetizable material, which when the drawer is inserted cooperates with the magnet and keeps the drawer in its front region in the raised position by means of the magnetic field produced.

However, it is also possible to keep drawer 3 in housing 10 by utilizing the fact that like magnetic poles repel one another. For this purpose in its front region facing base plate 26 of housing 10, drawer 3 carries a magnet, whilst the base plate is provided in its front region with a magnet facing the magnet on the drawer, the magnetic poles of the two magnets being in the same direction and facing one another, i.e. The south poles and/or north poles of the magnet face one another, so that in the inserted state the drawer is kept in the raised position due to the identity of the facing poles of the two magnets and the mutually repelling magnetic poles.

What is claimed is:

1. A telephone index with an index ca rd selection device, comprising:

a housing having a cover and a base, said base having a base plate, a plurality of selection keys in the cover, a drawer for movement into and out of the housing, a spring for opening said drawer outwardly of the housing, said drawer defining a front region in the direction in which the drawer is opened and defining a bottom, a locking device for holding the drawer in the housing against the force of the spring, said drawer being arranged for receiving a stack of a plurality of index cards with selection stampings formed in the front region in the direction in which the drawer is opened, card hold-back pins in said housing, selection keys for actuating said card hold-back pins so they engage selection stampings of the index cards and for holding back the index cards above the engaged selection stamping when the spring moves the drawer outwardly of the housing, drivers on the bottom of the drawer for engaging the selected index card and underlying index cards when the drawer is moved outwardly, an unlocking device controllable by means of said selection keys for releasing the locking device for the drawer, biasing means of biasing the drawer upwardly toward said cover into a raised locking position in its front region away from the base plate of the base of the housing, said locking means including a stop on the cover for locking the drawer onto the cover of the housing, each selection key having a release arm for acting on the front region of the drawer on operation of a selection key and simultaneously pivoting a card hold-back pin with the release arm and having a rearwardly directed index card abutting surface said locking means and said biasing means being arranged so that pressing down a selection key forces the drawer with its front region down against the biasing means in the direction of the base and so that the release arm produces simultaneous release of the locking of the drawer on the cover and lowers the card hold-back pin onto a selected index card while simultaneously holding back the index cards located above said card.

2. A telephone index according to claim 1, wherein the drawer includes an index card stack reception plate having an upwardly directed driver for moving the card toward the front region, and a vertically-directed terminal ledge at the front region for closing the drawer with the cover of the housing, said locking means including a central locking cam on said ledge, said cover having a front wall with a lower edge, said terminal ledge being held in a raised position by said biasing means in the front region of the base plate of the base of the housing such that the locking cam engages the lower edge of the front wall of the cover for locking the drawer, a resilient-elastic portion on each selection key for holding the locking in an inoperative position, said cover having a front inner wall surface for mounting said resilient-elastic portion one of said release arms and one of said card hold-back pins being operative for engaging the selection stampings in the front region of the index cards and moving towards the base plate of the base part of the housing, the number of release arms and card hold-back pins being the same as the selection keys and being so arranged with respect to one another a nd connected to the selection keys that on depressing a selection key the release arm associated therewith acts on the front terminal ledge of the drawer and presses the latter against the resilient-elastic portion formed in the base plate of the base while simultaneously releasing the locking cam from its locking position on the lower edge of the front wall of the cover and while simultaneously downwardly moving the drawer in its front region, the card hold-back pin in advance of the release arm simulating the particular selected index card to hold the index cards above the selected back in the housing on opening of the drawer.

3. A telephone index according to claim 1, wherein each index card has a rear region and a front region and each rear region has a driving stamping and in its front region selection stampings, whose number corresponds to the number of selection keys, the selection stampings being formed by wave-like profiles and wherein the selection stampings of all the index cards are congruent, the recesses of the selection stampings being located in the movement path of the card hold-back pins.

4. A telephone index according to claim 1, wherein the front terminal ledge of the drawer is provided on its inner wall surface with a ledge having a number of recesses corresponding to the number of selection keys with bearing surfaces for the release arms.

5. A telephone index according to claim 4, wherein the ledge is an integrated component of the front terminal ledge of the drawer and forms a constructional unit with the terminal ledge.

6. A telephone index according to claim 1, wherein the spring for opening the drawer includes a spiral spring tensioned at right angles to the opening direction above the base plate of the base part of the housing and which is located roughly in the front third of the base and wherein the index card stack reception plate includes a member located centrally in the rear region of the plate acting on the spring.

7. A telephone index according to claim 1, wherein the biasing means includes a resilient-elastic portion formed in the front region of the base plate of the base from the base plate material and is constructed as a spring tongue-like element, said resilient-elastic portion assuming a raised position when the drawer is opened outwardly and after depression automatically springs back from its depressed position into the raised starting position.

8. A telephone index according to claim 7, wherein the base plate of the base is made from a resilient-elastic plastic having a high recovery capacity.

9. A telephone index according to claim 7, wherein the resilient-elastic portion in the base plate of the base extends roughly over the entire width of the base plate.

10. A telephone index according to claim 7, wherein in the front region of the base plate of the base part are formed centrally with respect to said plate a tongue-like, resilient-elastic portion or several juxtaposed tongue-like, resilient-elastic portions.

11. A telephone index according to claim 1, wherein in the front region of the base plate of the base of the housing is formed a resilient-elastic portion, which is connected by means of film hinge to the remainder of the base plate, the base-side wall surface of the portion being directed conically towards the front, free end of the resilient-elastic portion, so that when the drawer is in the engagement position, said end is at a distance from the plane formed by the underside of the base plate.

12. A telephone index according to claim 1, wherein the release arm and the card hold-back pin of each selection key have rear region and are constructed as tongue-like portions, which are resilient-elastic in their rear regions for automatically springing back from a pivoted down position into a starting position, the card hold-back pin being in advance of the release arm on depressing the release arm, wherein the release arm and the card hold-back pin form a unit and wherein all units comprising a release arm and a card hold-back pin are combined to form a selection key plate fixed to the inner wall surface of the upper cover plate of the cover part, a selection key being connected to each release arm.

13. A telephone index according to claim 1, wherein the section key plate comprises pairwise combined released arms and card hold-back pins.

14. A telephone index according to claim 1, wherein each card hold-back pin comprises on tongue-likearm having a front free end with a portion bent in the direction of the base plate of the base, said arm having a free bottom-side for carrying an index card abutting surface directed into the housing and which is constructed in clasp-like manner.

15. A telephone index according to claim 1, wherein on the upper edge of the terminal ledge of the drawer, the locking cam has n free upper end with a guidance surface inclined in the direction toward the housing.

16. A telephone index according to claim 1, wherein the cover includes an upper telephone reception surface having a corrugated or grooved profile running at right angles to the direction in which the drawer is opened by said spring.

17. A telephone index according to claim 16, wherein the corrugated or grooved profile in the upper surface extends into the side wall region of the cover part.

18. A telephone index according to claim 1, wherein the cover includes a magnet, the drawer carrying in its front region magnetizable means made from a magnetizable material, which when the drawer is inserted cooperates with the magnet and keeps the front region of the drawer in the raised position.

19. A telephone index according to claim 1, wherein the front region of the drawer facing the front region of the base carries a magnet facing the magnet on the drawer, the magnetic poles of the two magnets being directed in the same direction as one another, so that when the drawer is in the inserted position it is kept raised, a result of the identity of the facing poles of the two magnets and the consequently mutually repelling magnetic poles.

* * * * *